US007520304B2

(12) United States Patent
Shimono et al.

(10) Patent No.: US 7,520,304 B2
(45) Date of Patent: Apr. 21, 2009

(54) FASTENER STRINGER OF CONCEALED TYPE SLIDE FASTENER

(75) Inventors: Muchiji Shimono, Toyama-ken (JP); Akihiro Yagyu, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/983,029

(22) Filed: Nov. 6, 2007

(65) Prior Publication Data

US 2008/0110211 A1 May 15, 2008

(30) Foreign Application Priority Data

Nov. 9, 2006 (JP) ..... 2006-303696

(51) Int. Cl.
*A44B 19/54* (2006.01)

(52) U.S. Cl. ..... 139/384 B; 24/393

(58) Field of Classification Search ..... 139/116, 139/11, 35, 384 B; 66/195, 190, 192, 193; 24/292, 392, 393
See application file for complete search history.

(56) References Cited

U.S. PATENT DOCUMENTS 3,179,996 A * 4/1965 Clauss ..... 24/408
4,099,302 A * 7/1978 Frohlich et al. ..... 24/392
4,143,680 A * 3/1979 Murai et al. ..... 139/384 B
4,682,635 A * 7/1987 Ofusa et al. ..... 139/116.2
5,035,267 A * 7/1991 Shimono ..... 139/116.1
5,832,961 A * 11/1998 Shimono ..... 139/116.1
7,293,434 B2 * 11/2007 Ikeguchi et al. ..... 66/193

FOREIGN PATENT DOCUMENTS

JP 2-132419 U 11/1990
JP B2-3414110 4/2003

* cited by examiner

*Primary Examiner*—Danny Worrell
(74) *Attorney, Agent, or Firm*—Alston & Bird LLP

(57) ABSTRACT

The invention provides a fastener stringer for a concealed type slide fastener, wherein the fastener stringer comprises: a fastener tape having a tape main body portion and an element attaching portion; and fastener element row, a side edge of the tape main body portion being folded back into a U shape and a coupling head of the fastener element row being projected outward, the element attaching portion being provided with plural upper and lower fixing warp yarns running on upper and lower leg portions of an element and plural tightening warp yarns running to stride over the leg portions alternately while intersecting one another between the leg portions, a total fineness of the lower fixing warp yarns on a coupling head side with respect to the tightening warp yarns is higher than that of the upper fixing warp yarns on the same side with respect to the tightening warp yarns.

8 Claims, 5 Drawing Sheets

FASTENER STRINGER OF CONCEALED TYPE SLIDE FASTENER

BACKGROUND OF THE INVENTION

1. Field of the Invention

The present invention relates to a fastener stringer for a concealed type slide fastener whose fastener element rows in a coupled state are not seen from a tape surface when the fastener element rows in a continuous shape woven along element attaching portions of a pair of right and left fastener tapes are coupled with each other.

2. Description of Related Art

A concealed type slide fastener has a concealing performance of making fastener element rows invisible by coupling the fastener element rows woven along right and left fastener tapes. For this reason, the concealed type slide fastener has been used preferably in various kinds of clothes, shoes and the like by taking an advantage that the concealed type slide fastener does not hamper a design feature due to the concealing performance thereof.

Examples of such a concealed type slide fastener have been disclosed in, for example, Japanese Patent No. 3414110 and Japanese Utility Model Application Laid-Open publication (JP-U) No. 2-132419. In a concealed type slide fastener 54 described in Japanese Patent No. 3414110, as shown in FIG. 5, a fastener tape 42 is woven with a foundation warp yarn 48 and a foundation weft yarn 49, and a coil type fastener element row 41 is woven in an element attaching portion 47 of the fastener tape 42 with a fixing warp yarn 51 and a fixing weft yarn 52 such that coupling heads 44 face inward of the fastener tape 42.

According to Japanese Patent No. 3414110, a plurality of core threads 50 pass on a side of a connecting portion 45 of the fastener element row 41 so that the fixing warp yarn 51 runs over an upper leg portion 46 of the fastener element row 41 and entangles with the foundation weft yarn 49 so as to sandwich the core thread 50 between the upper and lower leg portions 46. Further, the fixing weft yarn 52 is entangled with the fixing warp yarn 51 running between the core threads 50, and runs on an outer face of a core thread 50 on a side of the engaging head 44 so as to be entangled with the foundation weft yarn 49.

A side of a tape main body portion 55 of the fastener tape 42 in which the fastener element row 41 is woven into the element attaching portion 47 is folded back, and with the coupling head 44 of the fastener element row 41 projecting from that folded-back portion, right and left fastener element rows 41 are inserted into a guide path of a slider member 53 so as to constitute the concealed type slide fastener 54. As a result, the fastener element row 41 can be fixed firmly to the fastener tape 42 with simple weaving means, and further, a pitch between elements of the fastener element row 41 can be stabilized.

On the other hand, in a fastener stringer 61 for a concealed type slide fastener described in JP-U-2-132419, as shown in FIG. 6, a fastener tape 62 is woven with foundation warp yarn 78 and foundation weft yarn 79, and a coil-like fastener element row 63 is woven into an element attaching portion 80 formed on a side edge of the fastener tape 62 such that a coupling head 65 faces inward of the fastener tape 62.

In the fastener stringer 61 of JP-U-2-132419, the fastener element row 63 is woven into the fastener stringer 61 with tightening warp yarns 72, 73 running while being entangled with upper and lower leg portions 70, 71 of each element 68, a plurality of upper fixing warp yarns 76 and lower fixing warp yarns 77 running in a warp direction on each of a top surface 74 of the upper leg portion 70 and a bottom surface 75 of the lower leg portion 71 of each element, and a foundation weft yarn 79. The core threads as mentioned in Japanese Patent No. 3414110 are not disposed. According to JP-U-2-132419, the tightening warp yarns 72, 73 are disposed between the respective upper fixing warp yarns 76 and between the respective lower fixing yarns 77, and each of the upper fixing warp yarn 76 and the lower fixing warp yarn 77 is disposed on a coupling head 65 side with respect to the tightening warp yarns 72, 73.

By constructing the concealed type slide fastener using such a fastener stringer 61, an interval between the respective elements 68 of the fastener element row 63 is stabilized so as to prevent breaking of engagement of the chain, and a portion in which the fastener element row 63 is woven can be formed thinner, thereby providing a flexible concealed type slide fastener.

In recent years, the concealed type slide fastener has been more and more widely used due to its advantages, for example, in not only various kinds of clothes and bags but also seat covers for automobile seats and train seats. Thus, the concealed type slide fastener has been demanded to secure a high performance such as concealing performance, flexibility and high coupling strength even if it is used in diversified environments or under diversified conditions.

For example, if specifically speaking of a case where the concealed type slide fastener is used in an automobile seat cover, the seat cover generally covers a cushion body formed in a predetermined shape. At this time, the seat cover is formed in a smaller size than an external dimension of the cushion body, and the cushion body is covered in a compressed state to suppress generation of looseness and deformation in the external shape as much as possible.

Thus, if the concealed type slide fastener is used in the seat cover, fastener tapes of fastener stringers receive a strong lateral pulling force of being pulled from both right and left sides when fastener element rows are coupled with each other or in a coupling state. Therefore, the concealed type slide fastener is demanded not to lose the concealing performance even when the slide fastener receives such a lateral pulling force. The concealed type slide fastener is demanded to have flexibility or constructed with a smaller slider member for a cushion performance or for avoiding losing a tactile feeling of the cushion body.

However, the concealed type slide fastener 54 described in Japanese Patent No. 3414110 lacks flexibility because, as described above, the concealed type slide fastener 54 is constructed so that a plurality of core threads 50 pass in the fastener element row 41, thereby increasing a thickness of the fastener element row 41. Further, a size of the slider member 53 through which the fastener element rows 41 pass is increased, thereby giving a feeling of disharmony in the cushion performance and tactile feeling of the seat cushion.

On the other hand, the fastener stringer 61 of the concealed type slide fastener described in JP-U-2-132419 has an excellent flexibility because a thickness of the fastener element row 63 is small. However, when fastener tapes 62 receive a strong lateral pulling force of being pulled from both right and left sides, a gap is likely to be generated between the fastener tapes 62 on right and left sides. Consequently, the fastener element row 63 is visible on a front surface side, thereby deteriorating the concealing performance inherent in the concealed type slide fastener, which is a problem to be solved.

SUMMARY OF THE INVENTION

The present invention has been achieved in view of the above-described conventional problems, and an object of the invention is to provide a fastener stringer for a concealed type slide fastener in which no core thread passes in fastener element rows and even if a strong lateral pulling force is received when right and left fastener element rows are coupled with each other, the fastener element rows are not visible from a front surface side, thereby securing an excellent concealing performance.

To achieve the above object, the present invention provides a fastener stringer for a concealed type slide fastener, comprising: a pair of right and left woven fastener tapes, each of the fastener tapes having a tape main body portion and an element attaching portion formed on a side edge of the tape main body portion; and right and left continuous fastener element rows woven into the element attaching portion at a same time when the fastener tapes are woven, each element of each of the fastener element rows having: a coupling head; upper and lower leg portions extending from the coupling head and woven into the element attaching portion; and a connecting portion for connecting the upper and lower leg portions of adjoining elements, and the side edge of the tape main body portion being folded back into an U shape, and the coupling head of the fastener element row being projected outward from a U-shaped folded back portion, the fastener stringer being characterized in that the element attaching portion comprises: a plurality of upper fixing warp yarns and lower fixing warp yarns which run in a warp direction on an outside faces of the upper leg portion and the lower leg portion of each element of the fastener element row; and a plurality of tightening warp yarns which intersect one another between the upper and lower leg portions of the element and run in the warp direction so as to stride over the upper leg portion and the lower leg portion alternately, and among the plurality of lower fixing warp yarns, a total fineness of the lower fixing warp yarns running on a side of the coupling head with respect to the tightening warp yarns is higher than a total fineness of the upper fixing warp yarns running on the side of the coupling head with respect to the tightening warp yarns.

In this case, preferably, a fineness of a single yarn of the lower fixing warp yarns running on the side of the coupling head with respect to the tightening warp yarns is equal to a fineness of a single yarn of the upper fixing warp yarns running on the side of the coupling head with respect to the tightening warp yarns, and a quantity of the lower fixing warp yarns running on the side of the coupling head with respect to the tightening warp yarns is larger than a quantity of the upper fixing warp yarns running on the side of the coupling head with respect to the tightening warp yarns.

Preferably, a quantity of the lower fixing warp yarns running on the side of the coupling head with respect to the tightening warp yarns is equal to a quantity of the upper fixing warp yarns running on the side of the coupling head with respect to the tightening warp yarns, and the fineness of a single yarn of the lower fixing warp yarns running on the side of the coupling head with respect to the tightening warp yarns is higher than the fineness of a single yarn of the upper fixing warp yarns running on the side of the coupling head with respect to the tightening warp yarn.

In the fastener stringer of the present invention, it is preferable that weft yarns are disposed between the respective elements of the fastener element row on the element attaching portion, the weft yarns being inserted so as to run on a bottom surface side of the plurality of the lower fixing warp yarns and inverted via at least one of the lower fixing warp yarns disposed on a side of the connecting portion of the element, and then running on a top surface side of the plurality of upper fixing warp yarns.

Preferably, positioning warp yarns are disposed on the element attaching portion, the positioning warp yarns running in a warp direction while intersecting the weft yarns running on the bottom surface side of the lower fixing warp yarn and the weft yarns running on the top surface side of the upper fixing warp yarn so as to restrict a position in a weft direction of the upper and lower fixing warp yarns.

In the present invention, preferably, the plurality of lower fixing warp yarns running on a side of a coupling head with respect to tightening warp yarns are disposed separately in plural areas by the positioning warp yarns.

In this case, more preferably, two or more of the lower fixing warp yarns are disposed in an area nearest the coupling head of the areas separated by the positioning warp yarns. Still more preferably, more pieces of the lower fixing warp yarns are disposed in an area nearer the coupling head among the areas separated by the positioning warp yarns.

In the fastener stringer for a concealed type slide fastener of the present invention, a plurality of the upper fixing warp yarns and the lower fixing warp yarns running on each outside face of the upper leg portion and the lower leg portion of the element, and a plurality of tightening warp yarns running in the warp direction striding over the upper leg portion and the lower leg portion alternately while intersecting one another between the upper and lower leg portions of the element are disposed on the element attaching portion in which continuous fastener element rows are woven. The total fineness of the lower fixing warp yarn running on the side of the coupling head of the element with respect to the tightening warp yarns among the plurality of the lower fixing warp yarns is set higher than the total fineness of the upper fixing warp yarn running on the side of the coupling head with respect to the tightening warp yarns.

In the fastener stringer in which the fastener element row is woven into the element attaching portion having the above-mentioned configuration, for example, the concealed type slide fastener is constructed and it receives a strong lateral pulling force in a state in which right and left fastener element rows are coupled with each other. Even in this case, positions of the lower fixing warp yarns are never shifted because the plurality of the lower fixing warp yarns running on the side of the coupling head of the element with respect to the tightening warp yarns are disposed closely.

This prevents positions of U-shaped folded back portions of the fastener tapes from being opened to right and left sides, thereby blocking a gap from being generated between the right and left fastener tapes effectively. Thus, the fastener element rows are not seen from the front face side of the fastener tape, so that the concealed type slide fastener can maintain an excellent concealing performance even when a strong lateral pulling force is received.

Further, because the fastener stringer of the present invention can be constructed without causing the core thread to pass through the fastener element row, the thickness of the fastener element row can be reduced so as to secure appropriate flexibility. In this case, the slider member through which the fastener element row is made to pass can be constructed in a small size. Therefore, even when the concealed type slide fastener is used in an automobile seat cover, influence of the slider member upon the cushion performance and tactile feeling of a passenger seat can be reduced.

To make the total fineness of the lower fixing warp yarns lower than that of the upper fixing warp yarns in the fastener stringer of the present invention, the element attaching portion may be constructed so that the fineness of a single yarn of the lower fixing warp yarns running on the side of the coupling head with respect to the tightening warp yarns is equal to the fineness of a single yarn of the upper fixing warp yarns running on the side of the coupling head with respect to the tightening warp yarns, and that the quantity of the lower fixing warp yarns running on the side of the coupling head with respect to the tightening warp yarns is set larger than that of the upper fixing warp yarns running on the side of the coupling head with respect to the tightening warp yarns. Consequently, when the fastener tape is woven, for example, a same yarn may be used as the single yarn of the upper fixing warp yarns and the lower fixing warp yarns. Thus, manufacturing cost of the fastener stringer can be reduced, and further, by constructing supply units for the upper fixing warp yarns and the lower fixing warp yarns in a weaving machine with a same structure, a structure of the weaving machine can be simplified.

To set the total finesses of the lower fixing warp yarns higher than that of the upper fixing warp yarn in the present invention, the element attaching portion may be constructed so that the quantity of the lower fixing warp yarns running on the side of the coupling head with respect to the tightening warp yarns is equal to that of the upper fixing warp yarns running on the side of the coupling head with respect to the tightening warp yarns, and that the fineness of a single yarn of the lower fixing warp yarns running on the side of the coupling head with respect to the tightening warp yarns is higher than the fineness of a single yarn of the upper fixing warp yarns running on the side of the coupling head with respect to the tightening warp yarns. Consequently, the quantity of the lower fixing warp yarns does not need to be set higher than that of the upper fixing warp yarns in order to increase the total fineness of the lower fixing warp yarn, so that a number of guide bars in the weaving machine can be reduced. As a result, reduction of the weaving machine in size can be achieved, and working efficiency at the time of weaving can be improved.

In the fastener stringer of the present invention, the weft yarns, which runs on the bottom surface sides of the lower fixing warp yarns, are inverted via the lower fixing warp yarn disposed on the side of the connecting portion of the element, and then runs on the top surface side of the upper fixing warp yarns, is disposed on the element attaching portion of the fastener tape. Due to an arrangement of the weft yarns, the fastener element row can be stably woven into the element attaching portion together with the upper and lower fixing warp yarns and the tightening warp yarn so as to fix the fastener element row firmly.

Further, in the element attaching portion of the fastener tape, the positioning warp yarns, which run while intersecting the weft yarns running on the bottom surface side of the lower fixing warp yarns and the weft yarns running on the top surface side of the upper fixing warp yarn, is disposed on the element attaching portion of the fastener tape. Consequently, positions of the upper and lower fixing warp yarns and the tightening warp yarn can be restricted and stabilized, thereby preventing a position of the warp yarn from being shifted and the warp yarns from overlapping each other vertically. Further, the weft yarns can be blocked from being loose by intersecting the positioning warp yarns with the weft yarns. With this configuration, a weaving structure of the element attaching portion can be stabilized, so that the concealing performance and a coupling strength of the concealed type slide fastener can be maintained in a long period.

In the present invention, the plurality of the lower fixing warp yarns running on the side of the coupling head with respect to the tightening warp yarns are disposed separately in plural areas by the positioning warp yarns. Consequently, positions of the plural lower fixing warp yarns running on the side of the coupling head with respect to the tightening warp yarns can be prevented from shifted, and adjoining lower fixing warp yarns can be prevented from overlapping each other vertically. Thus, the weaving structure of the element attaching portion can be stabilized, thereby maintaining the concealing performance of the concealed type slide fastener more securely.

In this case, two or more of the lower fixing warp yarns, preferably, three or more of the lower fixing warp yarns are disposed in an area nearest the coupling head among the areas separated by the positioning warp yarns. Consequently, the element attaching portion of a predetermined length can be formed closely on the side of the coupling head with respect to the positioning warp yarns. This prevents a gap between the U-shaped folded back portions of the right and left fastener tapes from expanding, thereby maintaining the concealing performance of the concealed type slide fastener more securely.

Further, in the present invention, more pieces of the lower fixing warp yarns are disposed in an area nearer the coupling head among the areas separated by the positioning warp yarns. Consequently, when the right and left fastener element rows are coupled with each other, for example, after the fastener tapes are knitted while weaving the fastener element rows, the positions of the lower fixing warp yarns are prevented from moving to the side of the connecting portion of the element, while the upper fixing warp yarns can move easily to the side of the connecting portion of the element. As a result, the coupling strength of the fastener element rows can be intensified without deterioration of the concealing performance of the concealed type slide fastener.

DESCRIPTION OF THE PREFERRED EMBODIMENTS

Hereinafter, embodiments of the present invention will be described in detail with reference to the accompanying drawings.

First Embodiment

Figure 1:
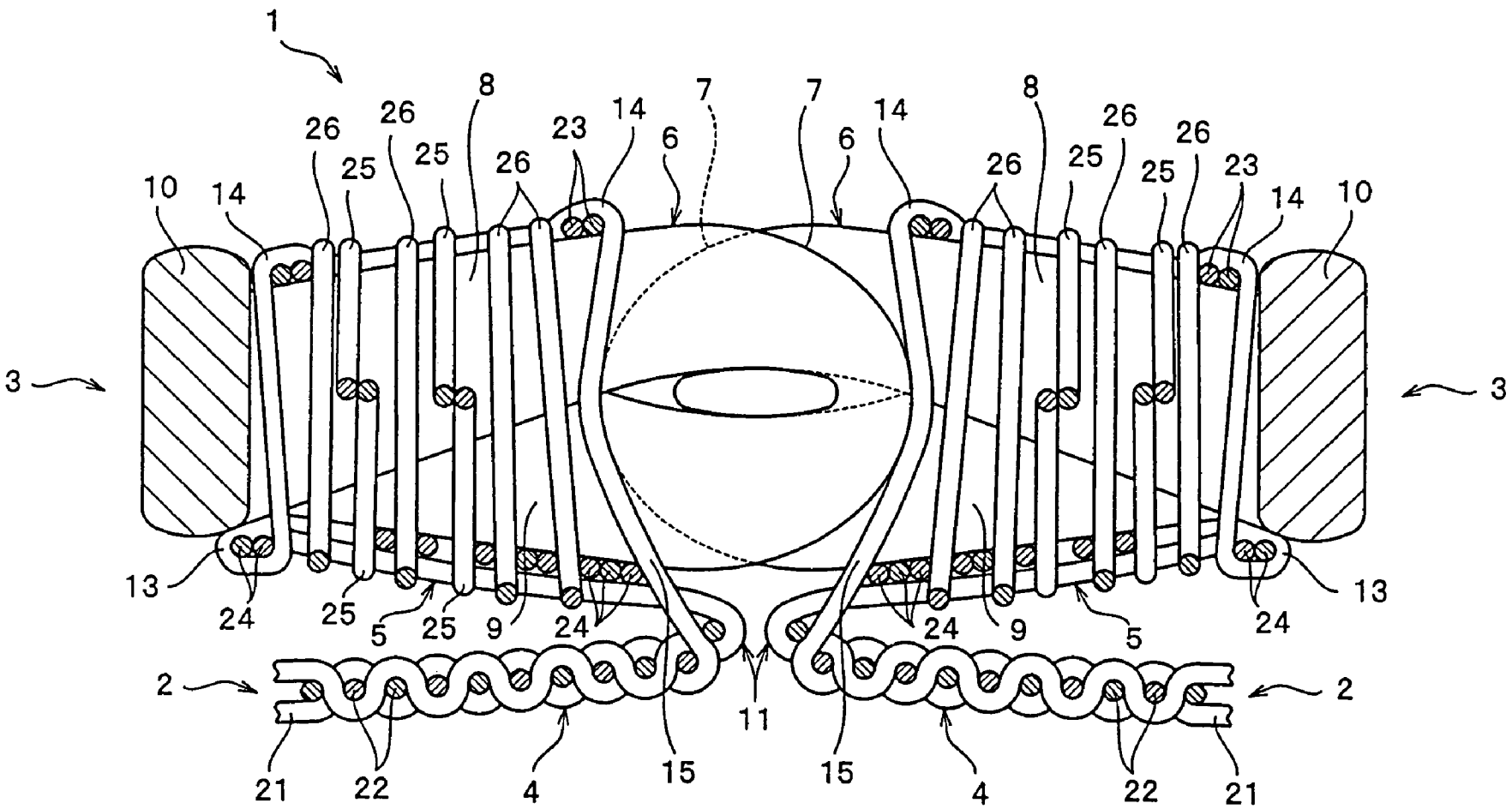
FIG. 1 is a cross-sectional view showing a cross-section of a fastener stringer for a concealed type slide fastener according to a first embodiment of the present invention, in a coupled state.
Figure 2:
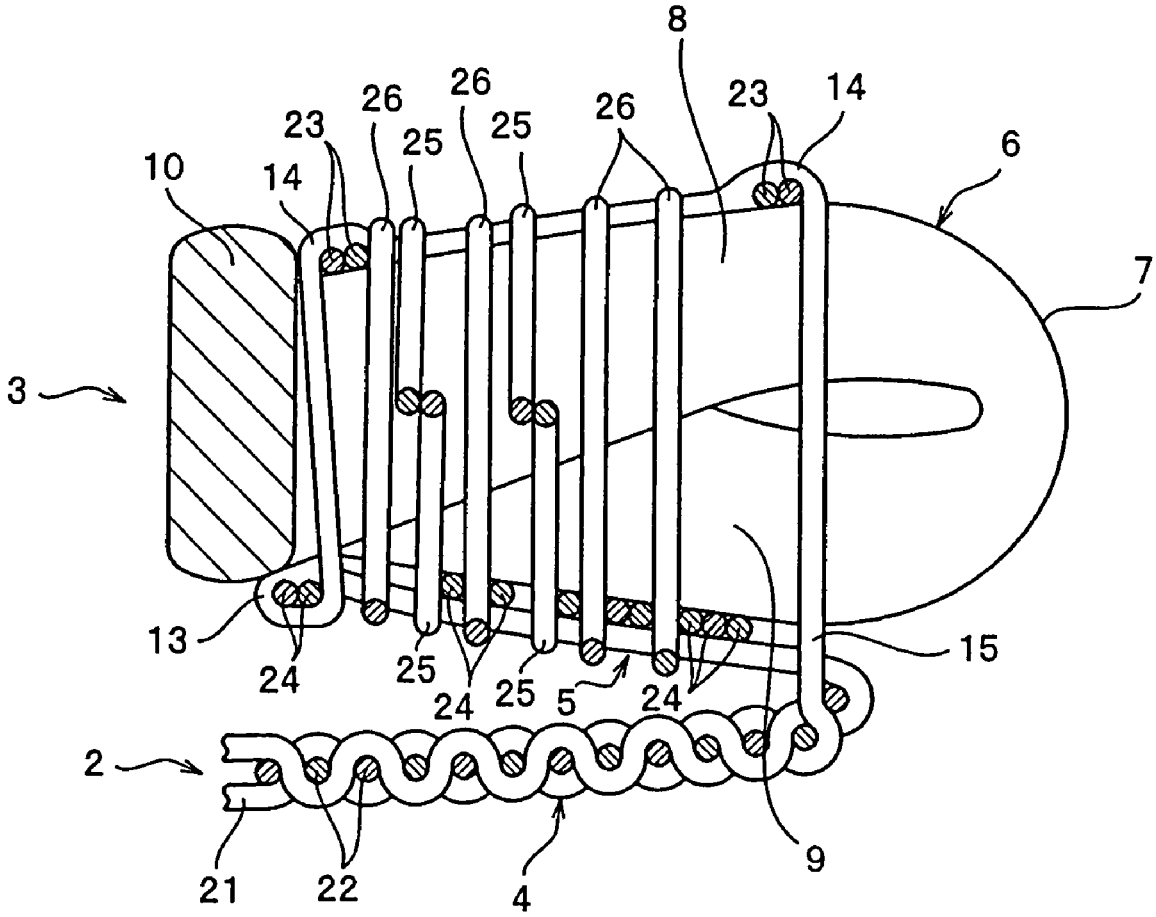
FIG. 2 is a cross-sectional view showing an arrangement of yarns in a fastener stringer on one side just after it is woven.
Figure 3:
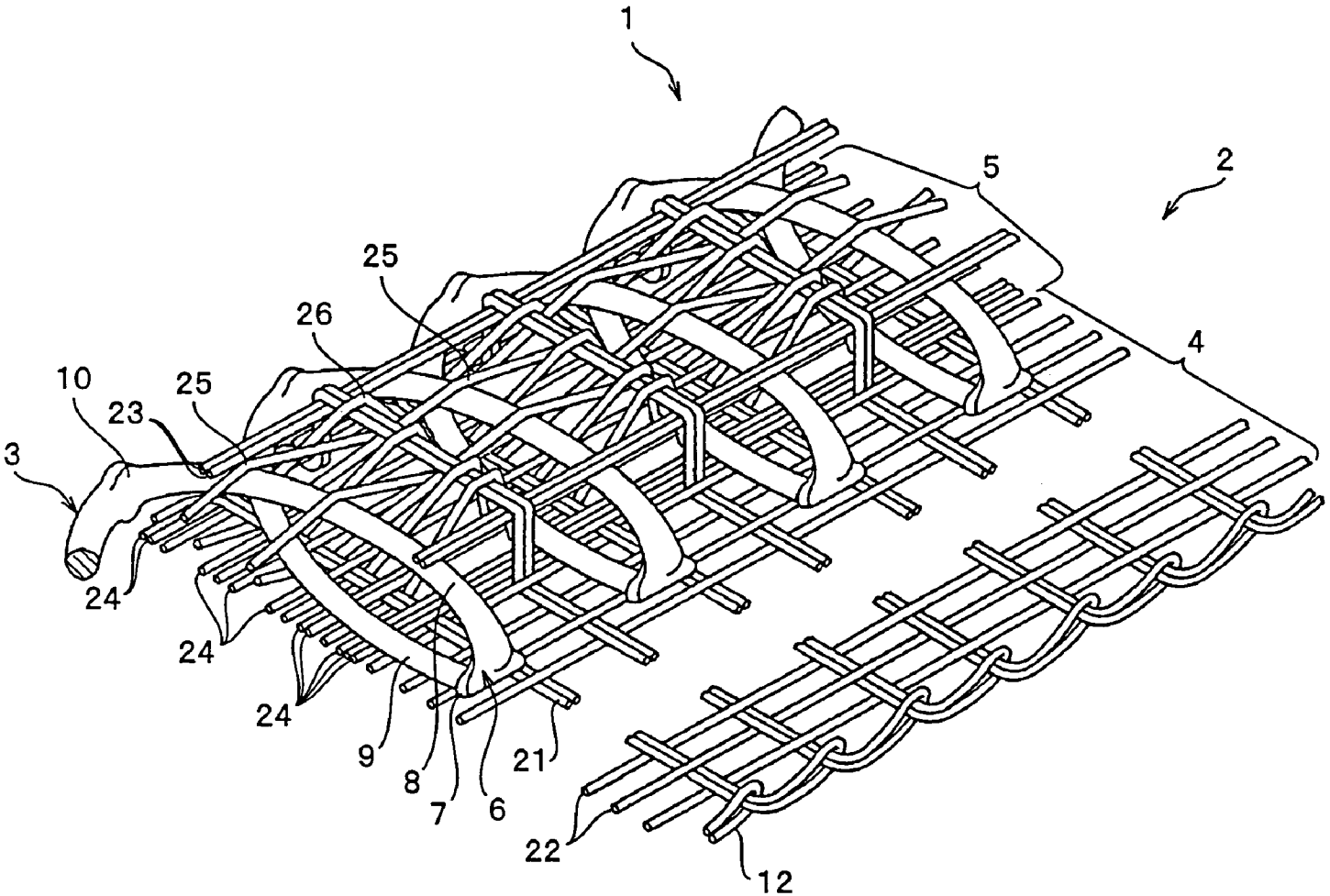
FIG. 3 is a partial perspective view schematically showing a weaving structure of the fastener stringer.

FIG. 1 is a cross-sectional view showing a section of a fastener stringer for a concealed type slide fastener according to a first embodiment of the present invention, in a coupled state. FIG. 2 is a cross-sectional view showing arrangement of yarns just after a fastener stringer on one side is woven. FIG. 3 is a partial perspective view schematically showing a weaving structure of the fastener stringer.

In these figures, weft yarns and various types of warp yarns are expressed as relatively thin and its weaving structure (weaving structure) is expressed roughly in order to facilitate understanding of features of the present invention. In actuality, however, yarns of required sizes are used for various kinds of the weft yarns and warp yarns and the weaving structure is constructed closely in consideration of a function of the fastener stringer.

The fastener stringer 1 for a concealed type slide fastener according to the first embodiment has a pair of right and left woven fastener tapes 2 and right and left coil-like fastener element rows 3 woven into the fastener tapes 2. Each of the fastener tapes 2 has a tape main body portion 4 and an element attaching portion 5 in which one of the fastener element rows 3 is to be woven, the element attaching portion 5 being formed on a side edge of this tape main body portion 4.

The fastener element row 3 has a plurality of elements 6 formed continuously into a coil-like configuration from synthetic resin mono-filament. Each of the elements 6 is comprised of a coupling head 7, upper and lower leg portions 8, 9 formed so as to extend from the coupling head 7, and a connecting portion 10 which connects each of extended ends of the upper and lower leg portions 8, 9 to any of the upper and lower leg portions 8, 9 adjacent each other in a back-forth direction of a tape longitudinal direction.

In the fastener element row 3, as shown in FIG. 3, the upper and lower leg portions 8, 9 are woven into the element attaching portion 5 with the coupling head 7 facing inward of the fastener tape 2 at a same time when the fastener tape 2 is woven, so that the fastener element row 3 is mounted on the fastener tape 2. After the fastener tape 2 is woven such that the fastener element row 3 is woven in, the side edge of the tape main body portion 4 is folded back into a U shape and set by heat with the coupling head 7 of the fastener element row 3 projecting outward from a U-shaped folded back portion 11. Consequently, the fastener stringer 1 for a concealed type slide fastener according to the first embodiment is obtained.

As shown in FIG. 3, the weaving structure of the fastener tape 2 in the fastener stringer 1 of the first embodiment is formed by inserting foundation weft yarns 21 by reciprocating a carrier bar in an opening of the warp yarns, and the tape main body portion 4 is woven with the foundation weft yarns 21 as ply yarn and foundation warp yarns 22. A knitting needle (not shown) is inserted into an end portion of the tape main body portion 4 on an opposite side to a side in which the element attaching portion 5 is formed. Then, the foundation weft yarns in a next position are hooked successively to join the loop like folded-back ends with each other, thereby producing an ear portion 12.

As shown in FIGS. 2 and 3, the element attaching portion 5 of the fastener tape 2 is comprised of ten lower fixing warp yarns 24 running in a warp direction on a bottom surface side of the lower leg portion 9 of each element 6, four upper fixing warp yarns 23 running in the warp direction on a top surface side of the upper leg portion 8 of the element 6, four tightening warp yarns 25 running in the warp direction such that they intersect one another between the upper and lower leg portions 8, 9, positioning warp yarns 26 for restricting positions of the upper and lower fixing warp yarns 23, 24 in a weft direction, and the foundation weft yarns 21 inserted laterally from the tape main body portion 4.

The lower fixing warp yarns 24 are disposed on a substantially same plane as the weaving structure of the tape main body portion 4 at a time of weaving. Six lower fixing warp yarns 24 are disposed on a side of the coupling head 7 of the element 6 with respect to the tightening warp yarns 25. Two lower fixing warp yarns 24 are disposed on a side of the connecting portion 10 of the element 6 with respect to the tightening warp yarns 25, and an inverting portion 13 for inverting the foundation weft yarns 21 is formed of these two lower fixing warp yarns 24. Further, two lower fixing warp yarns 24 are disposed between two sets of the tightening warp yarns 25. These ten lower fixing warp yarns 24 are disposed on the bottom surface side of the lower leg portion 9 of the element 6 to makes it possible to stably form a mounting face capable of mounting and supporting the fastener element row 3.

Two pieces of the upper fixing warp yarns 23 are disposed on the side of the coupling head 7 and the side of the connecting portion 10 of the element 6 with respect to the tightening warp yarns 25. The upper fixing warp yarns 23 which make a pair form a bending portion 14 which bend the foundation weft yarns 21 running on a side of the upper leg portion 8 of the element 6 toward a lower leg portion 9 side. The two upper fixing warp yarns 23 disposed on the side of the coupling head 7 are just pressed to the side of the upper leg portion 8 by the foundation weft yarns 21 as shown in FIG. 2 just after the fastener tape is woven. For this reason, for example, after the fastener tape 2 is woven, a longitudinal running portion 15 of each of the foundation weft yarns 21 running in a longitudinal direction between the upper leg portion 8 and the lower leg portion 9 is pressed in toward the connecting portion 10 side, so that the upper fixing warp yarns 23 is moved easily toward the side of the connecting portion 10 on the upper leg portion 8.

In the first embodiment, two pieces of the lower fixing warp yarns 24 or the upper fixing warp yarns 23 are disposed on the inverting portion 13 which inverts each of the foundation weft yarns 21 and on the bending portion 14 which bends each of the foundation weft yarns 21. Consequently, the strength at an end portion of the element attaching portion 5 can be intensified, so that even if a large load is applied by the foundation weft yarns 21 to the inverting portion 13 or the bending portion 14, fuzz at the inverting portion 13 or the bending portion 14 or breaking of the upper and lower fixing warp yarns 23, 24 can be blocked.

The tightening warp yarns 25 run such that they intersect each other between the upper and lower leg portions 8 and 9 of the element 6 and stride over the upper leg portion 8 and the lower leg portion 9 alternately so as to tighten the upper and lower leg portions 8, 9 in the vertical direction. Further, the tightening warp yarns 25 are disposed such that adjacent two pieces thereof, the running direction of which are symmetrical with respect to a upper and lower direction, make a pair and two pairs of the tightening warp yarns 25 are arranged with a predetermined interval. Because the tightening warp yarns 25 are disposed, the fastener element row 3 can be woven firmly into the element attaching portion 5, and a pitch between the respective elements 6 of the fastener element row 3 woven into can be stabilized.

The positioning warp yarns 26 runs in the warp direction while intersecting the foundation weft yarns 21 running on the bottom surface side of the lower fixing warp yarn 24 and the foundation weft yarns 21 running on the top surface side of the top fixing warp yarn 23. Four of the positioning warp yarns 26 are disposed on the element attaching portion 5. Due to such an arrangement of the positioning warp yarns 26, the fastener element row 3 can be fixed stably to the element attaching portion 5 so as to prevent the foundation weft yarns 21 from being loose.

One of these four positioning warp yarns 26 is disposed on the side of the connecting portion 10 of the element 6 with respect to the tightening warp yarns 25 so as to restrict positions of the two upper fixing warp yarns 23 disposed on the side of the connecting portion 10 of the element 6. One of the positioning warp yarns 26 is disposed between the two pairs of the tightening warp yarns 25, and positions of the two lower fixing warp yarns 24 are restricted by the one positioning warp yarn 26 and the two tightening warp yarns 25. In the first embodiment, the upper and lower fixing warp yarns 23, 24 are prevented from being shifted in a right and left width direction by the positioning warp yarns 26 disposed on the side of the connecting portion 10 so as to stabilize a fixing of the fastener element row 3.

Two of the positioning warp yarns 26 disposed on the side of the coupling head 7 of the element 6 with respect to the tightening warp yarns 25 restrict positions of six of the lower fixing warp yarns 24 disposed on the side of the coupling head 7 with respect to the tightening warp yarns 25. Particularly, the side of the coupling head 7 of the element 6 with respect to the tightening warp yarns 25 is divided into three areas by the two positioning warp yarns 26. The three lower fixing warp yarns 24, two lower fixing warp yarns 24 and one lower fixing warp yarn 24 are disposed separately in each area to restrict the positions of the lower fixing warp yarns 24.

In this way, the six lower fixing warp yarns 24 disposed on the side of the coupling head 7 are restricted by the positioning warp yarns 26 so as to prevent the positions of the lower fixing warp yarns 24 from being shifted or the plural lower fixing warp yarns 24 from overlapping one another vertically, thereby leading to stabilization of the element attaching portion 5.

Particularly in the first embodiment, more pieces of the lower fixing warp yarns 24 are disposed in areas nearer the coupling head 7. Therefore, for example, when the right and left fastener element rows 3 are coupled with each other after the fastener tapes 2 are woven (see FIG. 1), the six lower fixing warp yarns 24 disposed on the side of the coupling head 7 are blocked from moving toward the side of the connecting portion 10 of the element 6 while the upper fixing warp yarns 23 are allowed to easily move toward the connecting portion 10 side.

This prevents the upper fixing warp yarns 23 and the foundation weft yarns 21 from running on the coupling head 7, thereby stabilizing a coupled state of the fastener element row 3 to intensify the coupling strength. Further, the six lower fixing warp yarns 24 are not moved to the side of the connecting portion 10 so as to prevent a distance between the U-shaped folded back portions 11 of the right and left fastener tapes 2 from expanding.

The foundation weft yarns 21 run on a bottom surface side of eight of the lower fixing warp yarns 24 from the tape main body portion 4 between the respective elements 6 of the fastener element row 3. The foundation weft yarns 21 are inverted via the two lower fixing warp yarns 24 (inverted portions 13) disposed on the side of the connecting portion 10 of the element, and runs toward the side of the upper leg portion 8. After the foundation weft yarns 21 run on the top surface side of the four upper fixing warp yarns, the foundation weft yarns 21 run in a longitudinal direction between the upper and lower leg portions 8, 9 and then are inserted laterally to return to the tape main body portion 4 or to run in an opposite direction. Because the foundation weft yarns 21 are inserted laterally in this way, the upper and lower leg portions 8, 9 of the element 6 can be fixed firmly to the element attaching portion 5 by weaving the upper and lower leg portions 8, 9 therein via the upper fixing warp yarns 23 and the lower fixing warp yarns 24 so as to sandwich.

In the first embodiment, a polyester processed yarn having a size of 330 decitex is used as each single yarn of the foundation weft yarns 21 and various kinds of the warp yarns 22, 23, 24, 25, 26 disposed in the tape main body portion 4 and the element attaching portion 5 of the fastener tape 2. In the meantime, a size and material of the foundation weft yarns and various kinds of the warp yarns are not restricted to any particular one but may be changed appropriately depending on a size of the fastener element row 3, an application of the concealed type slide fastener, and the like.

After the fastener stringer 1 having the weaving structure shown in FIG. 3 is woven, the side edge of the tape main body portion 4 of the fastener stringer 1 obtained is folded back and held in a state in which the coupling head 7 of the fastener element row 3 is projected from the U-shaped folded back portion 11. Further, heat setting treatment at a low temperature is executed on the fastener stringer 1 so as to stabilize a shape of the fastener stringer 1 for a preliminary purpose.

Subsequently, the right and left fastener element rows 3 are made to pass into a slider member (not shown) and the slider member is slid along the right and left fastener element rows 3, so that the right and left fastener element rows 3 are coupled with each other. When the right and left fastener element rows 3 are coupled with each other, as shown in FIG. 1, the longitudinal running portion 15 of each of the foundation weft yarns 21 running vertically between the upper and lower leg portions 8, 9 on the side of the coupling head 7 is pressed in the side of the connecting portion 10 of the element by a coupling head 7 of an opposing element.

When the longitudinal running portion 15 of the foundation weft yarns 21 are pressed in, the two upper fixing warp yarns 23 disposed on the side of the coupling head 7 with respect to the tightening warp yarns 25 and one of the positioning warp yarns 26 disposed nearest the coupling head 7 are moved to the side of the connecting portion 10 of the element. Consequently, the right and left fastener element rows 3 can be coupled with each other stably.

On the other hand, a quantity of the six lower fixing warp yarns 24 disposed on the side of the coupling head 7 with respect to the tightening warp yarns 25 are higher than a quantity of the upper fixing warp yarns 23 disposed on the side of the coupling head 7 with respect to the tightening warp yarns 25, while lower fixing warp yarns 24 being closely lined up. Consequently, even if the longitudinal running portion 15 of the foundation weft yarns 21 are pressed into the side of the connecting portion 10, the positions thereof are never shifted. Therefore, the position of the U-shaped folded back portion 11 of the fastener tape 2 is never moved relatively to the side of the connecting portion 10 of the element with respect to the fastener element row 3, thereby preventing a gap from being generated between the right and left fastener tapes 2.

By performing heat setting treatment upon the fastener stringer 1 in a coupled state as shown in FIG. 1, a shape of the fastener stringer 1 is stabilized, and the foundation weft yarns 21 and the various kinds of the warp yarns 22, 23, 24, 25, 26 are contracted thermally so as to make the weaving structure of the fastener tape 2 close, thereby fixing the fastener element row 3 firmly. Consequently, the concealed type fastener including the fastener stringer 1 of the first embodiment can be constructed. In the fastener stringer 1 shown in FIG. 1, a bottom side of a figure is a front face side when the concealed type slide fastener is constructed.

In the fastener stringer 1 of the first embodiment described above, the lower fixing warp yarns 24 running on the side of the coupling head 7 of the element 6 with respect to the tightening warp yarns 25 are disposed in a larger quantity and more closely than the upper fixing warp yarns 23 running on the side of the coupling head 7 with respect to the tightening warp yarns 25. A total fineness of the lower fixing warp yarns 24 running on the side of the engaging head 7 of the element 6 with respect to the tightening warp yarns 25 is higher than a total fineness of the upper fixing warp yarns 23 running on the side of the coupling head 7 with respect to the tightening warp yarns 25.

When the fastener tape 2 receives a strong lateral pulling force of being pulled from both right and left sides in a condition in which the fastener element rows 3 are in a coupled state as shown in FIG. 1, the positions of the lower fixing warp yarns 24 are never shifted. Thus, generation of a gap between the right and left fastener tapes 2 of the fastener stringer 1 can be prevented, thereby maintaining an excellent concealing performance of blocking the fastener element row 3 from being seen from a tape front surface side.

Because, in the fastener stringer 1 of the first embodiment, no core thread passes through the fastener element row 3, appropriate flexibility can be secured by reducing a thickness of the fastener element row 3. Further, because no core thread passes through the fastener element row 3, the slider member through which the fastener element row 3 is made to pass can be constructed in a smaller size. Thus, even when the concealed type slide fastener is used in an automobile seat cover, influences of the slider member upon a cushion performance and a tactile feeling of a passenger seat can be reduced.

Second Embodiment

Figure 4:
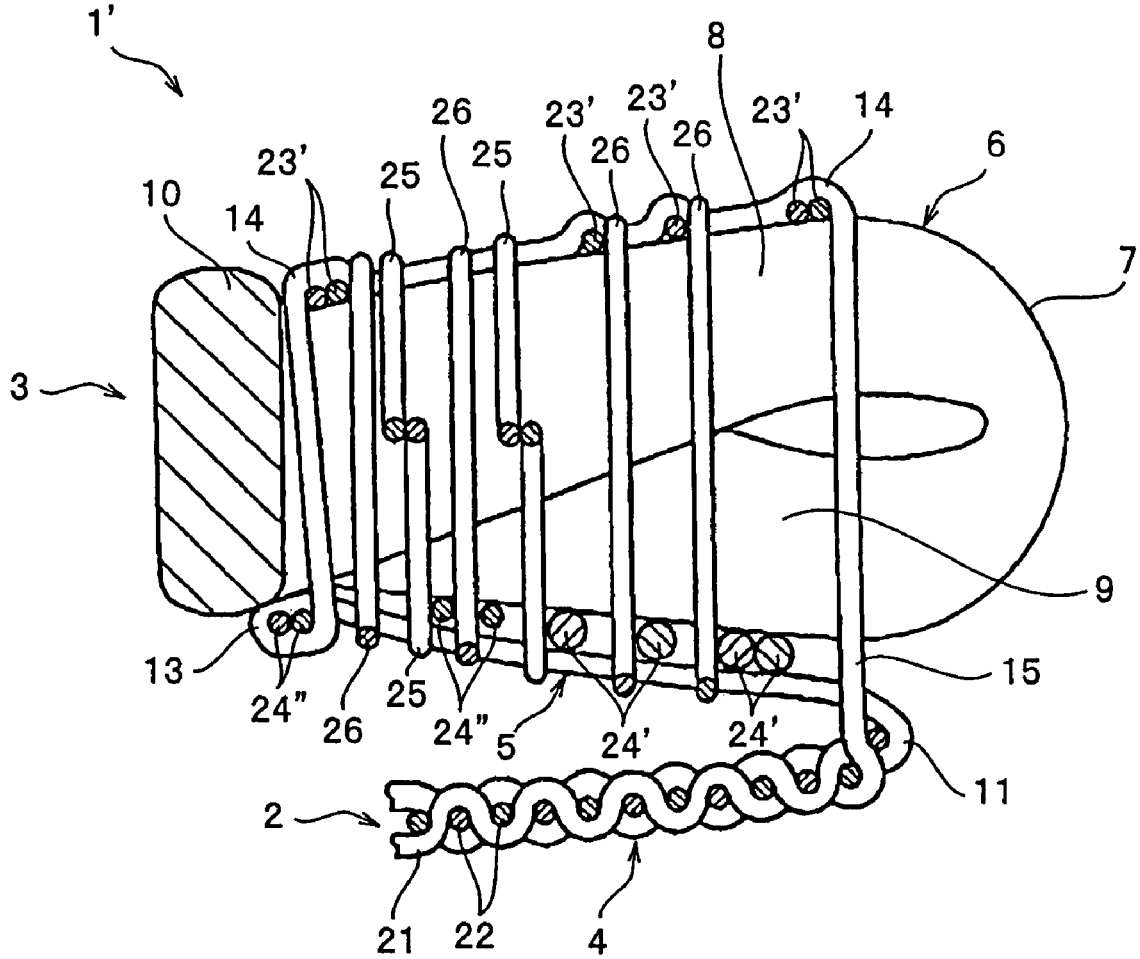
FIG. 4 is a cross-sectional view showing an arrangement of yarns in a fastener stringer for a concealed type slide fastener according to a second embodiment of the present invention just after it is woven.
Figure 5:
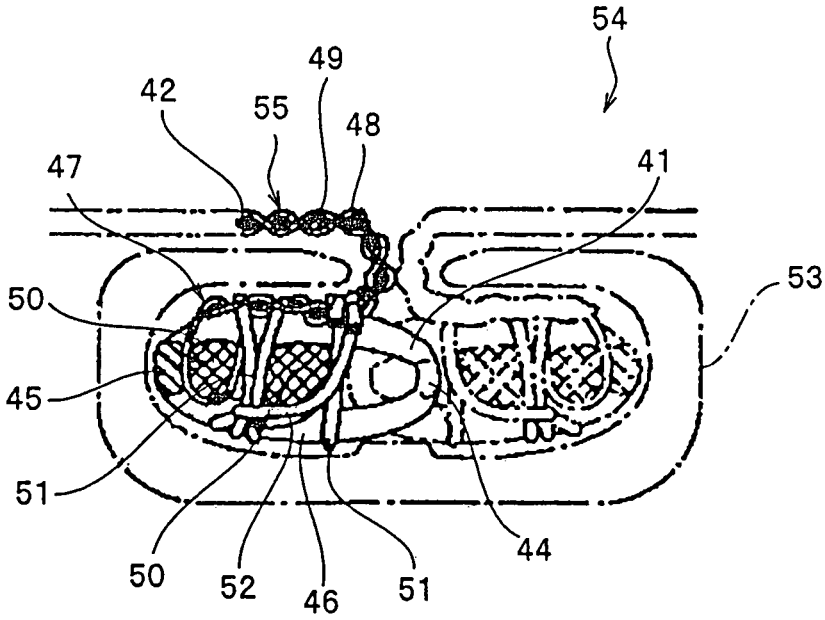
FIG. 5 PRIOR ART
FIG. 5 is a cross-sectional view showing a cross-section of a fastener stringer for a concealed type slide fastener in a prior art.
Figure 6:
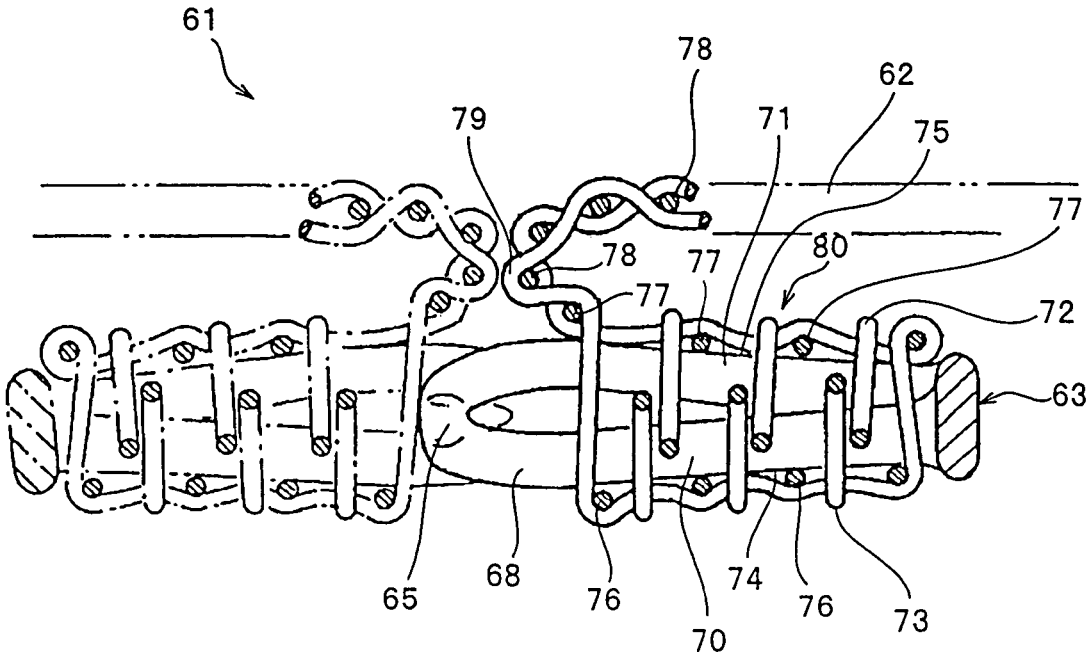
FIG. 6 PRIOR ART
FIG. 6 is a cross-sectional view showing a cross-section of another fastener stringer for a concealed type slide fastener in a prior art.

Next, a fastener stringer for a concealed type slide fastener according to a second embodiment of the present invention will be described with reference to the accompanying drawings. FIG. 4 is a cross-sectional view showing an arrangement of yarns just after the fastener stringer according to the second embodiment is woven. In the meantime, same reference numerals are attached to components having same configurations as those of the first embodiment, and descriptions of those components are omitted.

In a fastener stringer 1' according to the second embodiment, the element attaching portion 5 of the fastener tape 2 is comprised of eight lower fixing warp yarns 24', 24" running in the warp direction on the bottom surface side of the lower leg portion 9 of each element 6, six upper fixing warp yarns 23' running in the warp direction on the top surface side of the upper leg portion 8 of the element 6, four tightening warp yarns 25 running in the warp direction so as to intersect one another between the upper and lower leg portions 8, 9 of the element 6, positioning warp yarns 26 for restricting the positions of the upper and lower fixing warp yarns 23, 24 in the weft direction, and a foundation weft yarns 21 inserted from the tape main body portion 4.

The lower fixing warp yarns include four first lower fixing warp yarns 24' disposed on the side of the coupling head 7 with respect to the tightening warp yarns 25, and four lower fixing warp yarns 24" disposed between two pairs of the tightening warp yarns 25 or on the side of the connecting portion 10 with respect to the tightening warp yarns 25. According to the second embodiment, a polyester processed yarn having a size of 450 decitex is used for each single yarn of the first lower fixing warp yarns 24', and a polyester processed yarn having a size of 150 decitex is used for each single yarn of the second lower fixing warp yarns 24". By disposing the first and second lower fixing warp yarns 24', 24" on the bottom surface side of the lower leg portion 9, an attaching surface of the fastener element row 3 can be formed stably.

Among the aforementioned upper fixing warp yarns 23', four pieces thereof are disposed on the side of the coupling head 7 of the element 6 with respect to the tightening warp yarns 25, and two pieces of the four pieces of the upper fixing warp yarns 23' near the coupling head 7 form the bending portion 14 which bends the foundation weft yarns 21 running on the side of the upper leg portion 8 toward the side of the lower leg portion 9. Further, two pieces of the upper fixing warp yarns 23' are disposed on the side of the connecting portion 10 with respect to the tightening warp yarns 25 to thereby form the bending portion 14 as well. A polyester processed yarn having a size of 150 decitex is used for each single yarn of the upper fixing warp yarns 23.

Although in the second embodiment, the first lower fixing warp yarns 24' and the upper fixing warp yarns 23', which are disposed on the side of the coupling head 7 with respect to the tightening warp yarns 25, are equal in the quantity thereof, the size of the single yarn of the first lower fixing warp yarns 24' is set to 450 decitex while the size of the single yarn of the upper fixing warp yarns 23' is set to 150 decitex.

The single yarn of the first lower fixing warp yarns 24' is formed thicker than that of the upper fixing warp yarn 23'. With this configuration, even if the quantities of the first lower fixing warp yarns 24' and the upper fixing warp yarns 23' are equalized, the first lower fixing warp yarns 24' can be arranged more closely than the upper fixing warp yarns 23 running on the side of the coupling head 7 with respect to the tightening warp yarns 25 by increasing the total fineness of the lower fixing warp yarn 24 running on the side of the coupling head 7 with respect to the tightening warp yarns 25 over the total fineness of the upper fixing warp yarn 23 running on the side of the coupling head 7 with respect to the tightening warp yarns 25.

Consequently, when the fastener element rows 3 of the right and left fastener stringers 1' of the second embodiment are coupled with each other and the longitudinal running portion 15 of each of the foundation weft yarns 21 are pressed to the side of the connecting portion 10, the four first lower fixing warp yarns 24' are hard to move to the side of the connecting portion 10 although the upper fixing warp yarns 23' disposed on the side of the coupling head 7 with respect to the tightening warp yarns 25 are moved largely to the side of the connecting portion 10.

Further in the fastener stringer 1' of the second embodiment, even if the fastener tape 2 receives a strong lateral pulling force of being pulled from both right and left sides in a state in which the right and left fastener element rows 3 opposing each other are coupled with each other, the positions thereof are never shifted because the lower fixing warp yarns 24 are arranged closely. Therefore, generation of a gap between the right and left fastener tapes 2 of the fastener stringer 1 can be blocked, thereby maintaining an excellent concealing performance.

Further, in the fastener stringer 1' of the second embodiment, no core thread is made to pass through the fastener element row 3 like the first embodiment. Thus, the thickness of the fastener element row 3 can be reduced to secure appropriate flexibility. Because no core thread is made to pass through the fastener element row 3, the slider member through which the fastener element row 3 is made to pass can be constructed in a small size.

The present invention is not restricted to the embodiments described above but may be modified in various ways as long as substantially the same configuration as the present invention is possessed and the same operating effect is achieved. For example, although the above embodiments have been described by exemplifying the quantities of the various kinds of the warp yarns constituting the element attaching portion 5, the quantity of each of the various kinds of the warp yarns may be changed arbitrarily depending on a size of the fastener element row 3 or an application of the concealed type slide fastener.

The present invention enables the fineness of the single yarn of the lower fixing warp yarn 24 to be larger than that of the upper fixing warp yarn 23 although in the first embodiment, the finenesses of the single yarns of the lower fixing warp yarns 24 and the upper fixing warp yarns 23 are equalized. Consequently, when forming the concealed type slide fastener, the concealing performance of the concealed type slide fastener can be maintained securely. In the meantime, according to the present invention, the fineness of the single yarn of the lower fixing warp yarns 24 can be made lower than that of the upper fixing warp yarns 23 if the total fineness of the lower fixing warp yarn 24 running on the side of the coupling head with respect to the tightening warp yarns 25 is made higher than that of the upper fixing warp yarns 23.

Although in the second embodiment, the quantities of the first lower fixing warp yarns 24' and the upper fixing warp yarns 23' disposed on the side of the coupling head 7 with respect to the tightening warp yarns 25 are equal, the present invention allows the quantity of the first lower fixing warp yarns 24' to be larger than that of the upper fixing warp yarns 23 running on the side of the coupling head 7 with respect to the tightening warp yarns 25. Additionally, as long as the total fineness of the first lower fixing warp yarns 24' is larger than that of the upper fixing warp yarns 23 running on the side of the coupling head 7 with respect to the tightening warp yarns 25, the quantity of the first lower fixing warp yarns 24' can be smaller than that of the upper fixing warp yarns 23 running on the side of the coupling head 7 with respect to the tightening warp yarns 25.

According to the present invention, the excellent concealing performance of the concealed type slide fastener can be maintained securely when the concealing type slide fastener is formed, if the total fineness of the lower fixing warp yarn running on the side of the coupling head with respect to the tightening warp yarns is made higher than the total fineness of the upper fixing warp yarn running on the side of the coupling head with respect to the tightening warp yarns.

What is claimed is:

1. A fastener stringer for a concealed type slide fastener, comprising: a pair of right and left woven fastener tapes, each of the fastener tapes having a tape main body portion and an element attaching portion formed on a side edge of the tape main body portion; and right and left continuous fastener element rows woven into the element attaching portion at a same time when the fastener tapes are woven, each element of each of the fastener element rows having: a coupling head; upper and lower leg portions extending from the coupling head and woven into the element attaching portion; and a connecting portion for connecting the upper and lower leg portions of adjoining elements, and the side edge of the tape main body portion being folded back into an U shape, and the coupling head of the fastener element row being projected outward from an U-shaped folded back portion, wherein the element attaching portion comprises:

a plurality of upper fixing warp yarns and lower fixing warp yarns which run in a warp direction on outside faces of the upper leg portion and the lower leg portion of each element of the fastener element row; and a plurality of tightening warp yarns which intersect one another between the upper and lower leg portions of the element and run in the warp direction so as to stride over the upper leg portion and the lower leg portion alternately, and among the plurality of lower fixing warp yarns, a total fineness of the lower fixing warp yarns running on a side of the coupling head with respect to the tightening warp yarns is higher than a total fineness of the upper fixing warp yarns running on the side of the coupling head with respect to the tightening warp yarns.

2. The fastener stringer according to claim 1, wherein a fineness of a single yarn of the lower fixing warp yarns running on the side of the coupling head with respect to the tightening warp yarns is equal to a fineness of a single yarn of the upper fixing warp yarns running on the side of the coupling head with respect to the tightening warp yarns, and a quantity of the lower fixing warp yarns running on the side of the coupling head with respect to the tightening warp yarns is larger than a quantity of the upper fixing warp yarns running on the side of the coupling head with respect to the tightening warp yarns.

3. The fastener stringer according to claim 1, wherein a quantity of the lower fixing warp yarns running on the side of the coupling head with respect to the tightening warp yarns is equal to a quantity of the upper fixing warp yarns running on the side of the coupling head with respect to the tightening warp yarns, and a fineness of a single yarn of the lower fixing warp yarns running on the side of the coupling head with respect to the tightening warp yarns is higher than a fineness of a single yarn of the upper fixing warp yarns running on the side of the coupling head with respect to the tightening warp yarn.

4. The fastener stringer according to claim 1, wherein a weft yarn is disposed between the respective elements of the fastener element row on the element attaching portion, the weft yarn being inserted so as to run on a bottom surface side of the plurality of the lower fixing warp yarns and inverted via at least one of the lower fixing warp yarns disposed on a side of the connecting portion of the element, and then running on a top surface side of the plurality of upper fixing warp yarns.

5. The fastener stringer according to claim 4, wherein positioning warp yarns are disposed on the element attaching portion, the positioning warp yarns running in a warp direction while intersecting the weft yarn running on the bottom surface side of the lower fixing warp yarn and the weft yarn running on the top surface side of the upper fixing warp yarn so as to restrict a position in a weft direction of the upper and lower fixing warp yarns.

6. The fastener stringer according to claim 5, wherein the plurality of lower fixing warp yarns running on a side of a coupling head with respect to tightening warp yarns are disposed separately in plural areas by the positioning warp yarns.

7. The fastener stringer according to claim 6, wherein two or more of the lower fixing warp yarns are disposed in an area nearest the coupling head of the areas separated by the positioning warp yarns.

8. The fastener stringer according to claim 6, wherein more pieces of the lower fixing warp yarns are disposed in an area nearer the coupling head among the areas on a side of the coupling head and on a side of the connecting portion, the areas being separated by the positioning warp yarns.

US 7,520,304 B2
15 16

* * * * *